United States Patent [19]

Schelli et al.

[11] 4,408,521

[45] Oct. 11, 1983

[54] POWER PRESS WITH AUTOMATIC DIE CHANGING SYSTEM

[75] Inventors: William Schelli, Elmhurst; William E. Sindelar, Darien, both of Ill.

[73] Assignee: Danly Machine Corporation, Chicago, Ill.

[21] Appl. No.: 291,578

[22] Filed: Aug. 10, 1981

[51] Int. Cl.[3] ..... B30B 15/06

[52] U.S. Cl. ..... 100/229 R; 72/448; 251/149.7; 285/119; 100/918

[58] Field of Search ..... 100/221, 224, 229 R, 100/918; 72/446, 448; 339/15, 16 R, 255 R; 251/149.7; 285/119

[56] References Cited

U.S. PATENT DOCUMENTS

| | | | |
|---|---|---|---|
| 361,743 | 4/1887 | Berry . | |
| 422,602 | 3/1890 | Loflin et al. . | |
| 622,161 | 3/1899 | Patterson . | |
| 875,339 | 12/1907 | Foster . | |
| 1,275,614 | 8/1918 | Sherman . | |
| 1,474,066 | 11/1923 | Brown . | |
| 2,009,487 | 7/1935 | Ernst et al. . | |
| 2,013,320 | 9/1935 | Shank et al. . | |
| 2,241,344 | 5/1941 | Graham . | |
| 2,317,851 | 4/1943 | Fullerton . | |
| 2,327,117 | 8/1943 | Lorant . | |
| 2,701,461 | 2/1955 | Weingart . | |
| 2,732,113 | 1/1956 | Rice . | |
| 2,896,971 | 7/1959 | Kolar | 251/149.7 |
| 2,940,384 | 6/1960 | Munschauer et al. . | |
| 2,975,701 | 3/1961 | Munschauer et al. . | |
| 2,988,234 | 6/1961 | Barothy et al. | 100/229 R |
| 2,996,025 | 8/1961 | Georgeff . | |
| 3,002,479 | 10/1961 | Johansen et al. . | |
| 3,111,100 | 11/1963 | Georgeff . | |
| 3,134,350 | 5/1964 | Danly et al. . | |
| 3,207,065 | 9/1965 | Danly . | |
| 3,673,541 | 6/1972 | Volinskie | 285/119 X |
| 3,841,142 | 10/1974 | Aisuta et al. . | |
| 3,910,180 | 10/1975 | Yasuhara | 100/224 |
| 3,986,448 | 10/1976 | Seyfried . | |
| 4,293,174 | 10/1981 | Knickerbocker | 339/255 R |

*Primary Examiner*—Billy J. Wilhite

*Attorney, Agent, or Firm*—Leydig, Voit, Osann, Mayer & Holt, Ltd.

[57] ABSTRACT

An automatic die changing system for a power press having carriers for transporting dies to and from a work station in the press and having a plurality of air lines and electrical lines in the press for supplying compressed air and electrical power to the dies on the carriers. All of the air and electrical lines terminate at the surface of the press, with a normally closed valve at the end of each of the air lines and electrical contact means at the end of each of the electrical lines. A plurality of connectors are mounted on each of the carriers to register with the valves and electrical contacts when the carrier is positioned at the work station, and responsive to the lowering of the carrier onto the press bed to automatically connect the air and electrical lines at the surface of the bed with corresponding air and electrical lines for operating control devices associated with the dies on the carrier. The connectors for the air lines also have actuators for automatically opening the valves of the air lines in response to the lowering of the carrier onto the press bed.

8 Claims, 7 Drawing Figures

FIG. 1
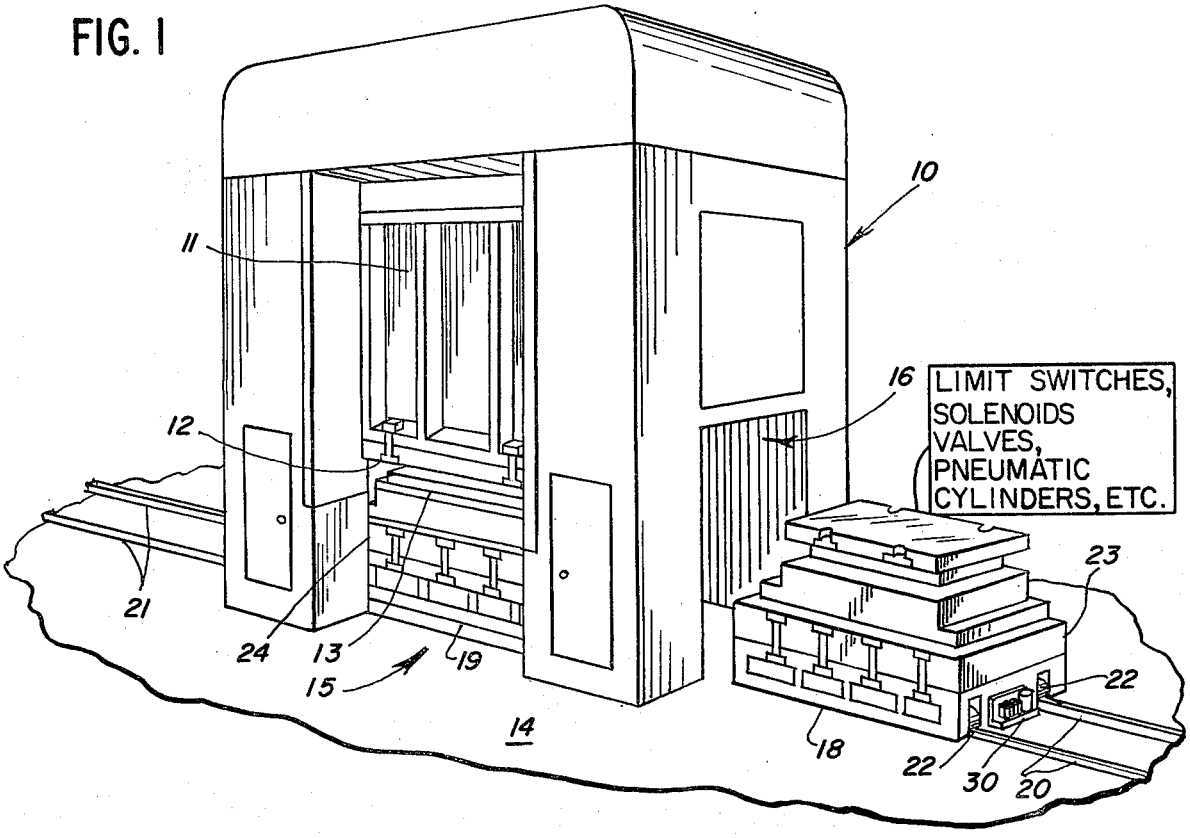
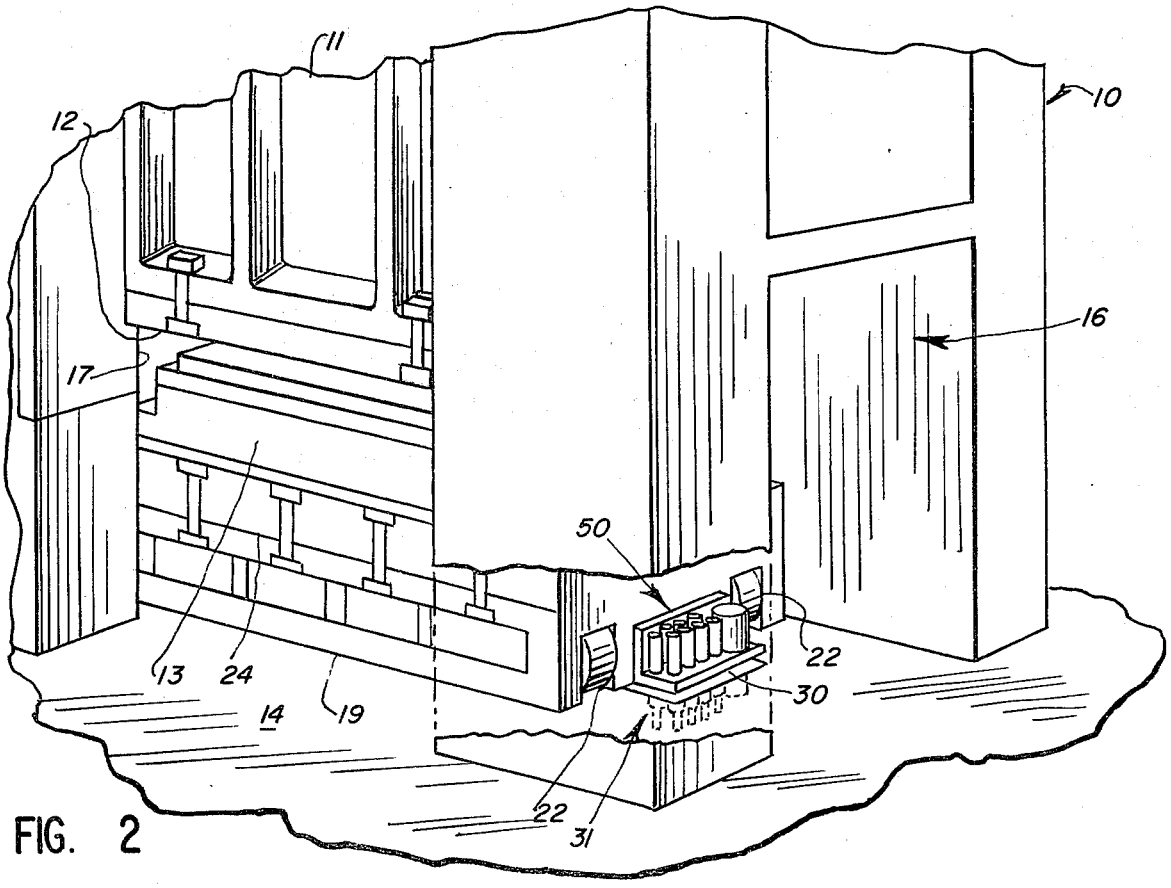
FIG. 2

POWER PRESS WITH AUTOMATIC DIE CHANGING SYSTEM

DESCRIPTION OF THE INVENTION

The present invention relates generally to automatic die changing systems for power presses. Such die changing systems typically use a power driven carrier or bolster plate for transporting die sets to and from a work station in a power press.

Although automatic die changing systems have been used in power presses for over 20 years, inefficiencies still remain in such systems in that the utility connections, e.g., for electricity and compressed air, must be made by manually connecting and disconnecting air hoses and electrical cables. These manual operations must be carried out each time a die set is transferred in or out of the press, which is not only time consuming but also can lead to improper connections due to human error from time to time or may be a hazard to the operator as he works in the die area making the necessary connections.

It is, therefore, a primary object of the present invention to provide an improved automatic die changing system which automatically makes the necessary utility connections and disconnections each time a die set is transferred to or from the press. In this connection, a related object of the invention is to provide such an improved die changing system which completely eliminates the need for manual operations to make and break the utility connections when changing dies, thereby increasing the productivity of the press and reducing labor costs and increasing safety.

It is another important object of this invention to provide an improved automatic die changing system which ensures that the utility connections are reliably and accurately made each time a die change is carried out.

A further object of this invention is to provide such an improved automatic die changing system which can be efficiently and economically incorporated in a power press.

Other objects and advantages of the invention will be apparent from the following detailed description and the accompanying drawings.

In accordance with the present invention, there is provided an automatic die changing system for a power press having carriers for transporting dies to and from a work station in the press, the system comprising a plurality of air lines and a plurality of electrical lines in the press bed for supplying compressed air and electrical power to the dies on the carriers, all of the air and electrical lines terminating at the surface of the press bed; a normally closed valve at the end of each of the air lines at the surface of the press bed; electrical contact means at the end of each of the electrical lines at the surface of the press bed; a plurality of connectors mounted on each of the carriers for movement therewith are positioned to register with the valves and electrical contact means at the surface of the press bed when the carrier is positioned at the work station, the connectors being responsive to the lowering of the carrier onto the press bed to automatically connect the air and electrical lines at the surface of the bed with corresponding air and electrical lines for operating control devices associated with dies on the carrier, and the connectors for the air lines having actuators for automatically opening the valves of the air lines in response to the lowering of the carrier onto the press bed.

IN THE DRAWINGS

FIG. 1 is a perspective view of a power press with an automatic die changing system embodying the invention;

FIG. 2 is an enlarged view of the lower right corner of the press of FIG. 1 with a portion of the press broken away to show the structure of the automatic die changing system within the press;

Figure 3:
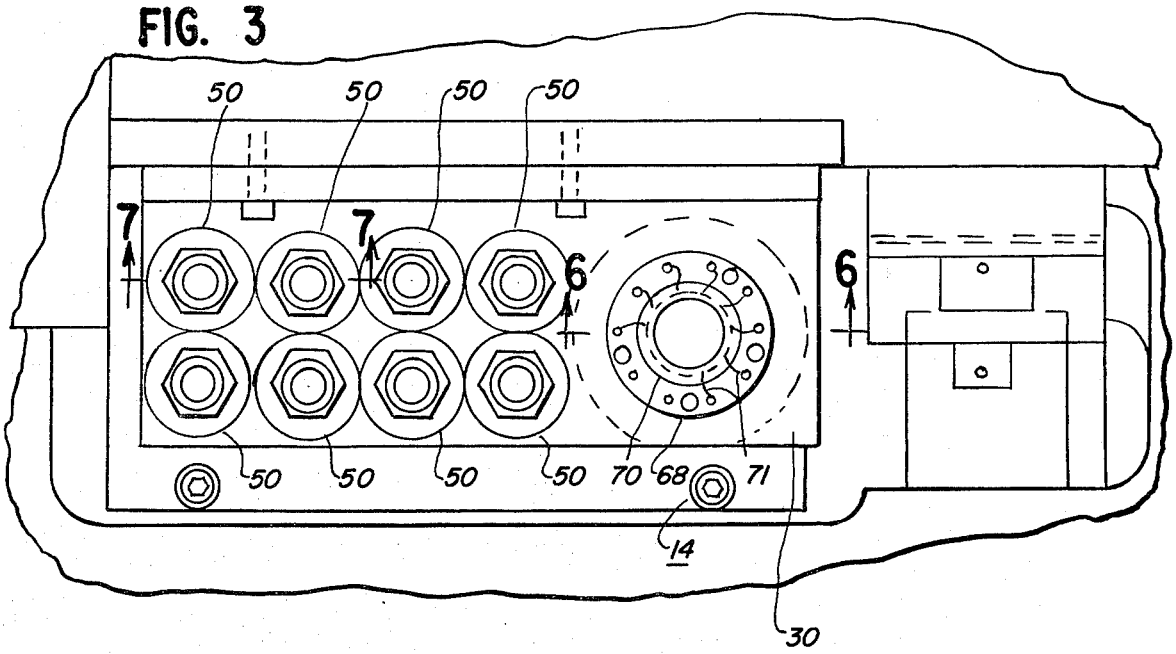
FIG. 3 is an enlarged plan view of the automatic utility connecting mechanism incorporated in the die changing system in the press of FIG. 1.

While the invention has been shown and will be described in some detail with reference to an exemplary embodiment of the invention, there is no intention that the invention be limited to that particular embodiment. On the contrary, it is intended to cover all modifications, alternatives and equivalent arrangements which fall within the spirit and scope of the invention as defined by the appended claims.

Turning now to the drawings and referring first to FIG. 1, there is shown a power press 10 having a slide 11 mounted for reciprocating movement in a vertical track and carrying a die 12 on the lower end thereof. A cooperating lower die 13 is mounted on the press bed 14 directly below the reciprocating slide 11. Workpieces are fed into the press through an opening 15 in the front of the press and positioned on the lower die 13 while the slide 11 is in a raised position. The workpiece is worked by the next downward stroke of the press slide, after which the workpiece is raised off the lower die 13 and removed from the press through the front opening 15 or through the rear of the press along the same axis.

For the purpose of automatically changing the dies 12 and 13, a pair of openings 16 and 17 are formed in opposite ends of the press to permit a pair of carriers 18 and 19 to have access to the interior of the press. The direction of movement of the carriers 18 and 19 is at right angles to the direction of movement of the workpieces so as to avoid interference with the automatic workpiece transfer mechanisms that are commonly used to load and unload the workpieces. The two carriers 18 and 19 enter the press from opposite ends so that whenever one of the carriers is in the press, or in the process of entering the press, the other carrier can be used to remove the old dies from the press and receive a new set of dies for the next die change. The carriers are guided to and from the press by two pairs of tracks 20 and 21, and are driven by air or electric motors which can be located directly on the carriers. Each carrier is equipped with four wheels 22 which ride on the respective tracks.

Whenever one of the carriers 18 or 19 enters the press, it is automatically stopped at the desired position within the work station, and the carrier drive motor is automatically de-energized. The lower die 13 and its carrier 18 or 19 are lowered onto the press bed 14 after which the upper die 12 is clamped to the bottom of the press slide 11. The clamping devices are usually automatically operated by separate air valves. In the particular design illustrated in the drawings, a press bolster plate 23 or 24 is disposed between the carrier 18 or 19 and the dies carried thereby, but it will be appreciated that in certain kinds of presses the bolster plate itself can be provided with wheels and serve as the carrier.

The automatic die changing system as described thus far is well known in the press art and is described, for example, in U.S. Pat. No. 3,111,100 to V. Georgeff.

Each time a carrier enters the press with a fresh set of dies, it is necessary to connect various air hoses and electrical lines to the new dies. For example, electricity is often needed for limit switches provided on the dies to sense when a workpiece is in the desired position on the lower die, and to operate solenoid valves used to control various pneumatic devices. Pneumatic cylinders are often used, for example, to lift the workpiece out of the lower die, after the workpiece has been formed, so that it can be gripped by an automatic unloading mechanism.

To permit automatic connection and disconnection of the various compressed air and electrical lines needed to service the various die sets mounted on the carriers 18 and 19, each of the carriers has an automatic connector plate 30 fastened to one end thereof. For reasons which will become apparent from the ensuing description, the connector plate 30 is preferably mounted on the outboard end of one carrier and on the inboard end of the other carrier. In the particular embodiment illustrated, each connector plate 30 has connectors for eight compressed air lines and ten electrical lines. These connectors are arranged to register with mating connectors recessed in the top surface of the press bed adaptor plate 14 when the carrier 18 or 19 is in its final position beneath the press slide 11. Then as the carrier is lowered onto the press bed adaptor plate 14, the connectors on the carrier plate 30 automatically mate with the connectors in the press bed adaptor plate 14 to effect the desired pneumatic and electrical connections. This furnishes the die set on the carrier 18 or 19 with compressed air and electricity because the connectors in the press bed adaptor plate 14 are permanently connected, via suitable control devices, to sources of compressed air and electrical power.

Referring to FIGS. 3–7 for a more detailed description of the various air and electrical connectors, each of the eight air line connectors 31 in the press bed includes a normally closed valve 32 having a stem 33 which projects slightly above the top surface of the bed adaptor plate 14. The bottom of this stem 33 is fastened to a retaining disc 34 (see FIG. 7) carrying a sealing ring 35 which is biased against a valve seat 36 by means of a compressed spring 37, thereby maintaining the valve in a normally closed condition. The valve seat 36 is formed by an upper body member 38 which defines an air chamber 39 adjacent the inner edge of the valve seat and communicating with six holes 40 clustered around the stem 33. The upper body member 38 is threaded into a lower body member 41 which defines an air chamber 42 around the outer edge of the valve seat 36 and communicating with a port 43 for receiving an air hose or pipe (not shown). The lower body member 40 is threaded into the underside of the press bed adaptor plate 14, so that the top of the upper body member 38 terminates flush with the top surface of the bed adaptor plate 14.

As will be appreciated from the foregoing description, the valve 32 will be opened by a downward force on the top end of the stem 33. The resulting downward movement of the stem 33 retracts the sealing ring 35 away from the valve seat 36, against the bias of the spring 37. Such downward movement of the valve stem 33 is effected by the lower surface of a mating connector 50 threaded into the carrier plate 30. That is, when one of the carriers 18 or 19 is lowered onto the press bed adaptor plate 14, one of the connectors 50 engages and depresses each of the valve stems 33, thereby opening the valves 32 to supply air to the die set on the carrier. The air passes through a cluster of six holes 51 formed in each connector 50 to register with the valve holes 40, and then on through a cavity 52 and port 53 formed in the top of the connector 50 for receiving an air hose from the die set on the carrier. The hose connections from the die set to the connector plate 30 are usually made while the dies are placed on the carrier 18 or 19 outside the press.

In order to form an air-tight seal between each of the connectors 50 and the corresponding valve 32, a sealing ring 54 is fastened to the lower end of each connector 50 by means of a collar 55 threaded onto the connector 50. This sealing ring 54 projects downwardly below the bottom surface of the connector 50 so that the ring 54 is pressed tightly against the top surface of the valve body member 38 by the weight of the carrier 18 or 19 and the dies thereon, thereby effecting the desired air-tight seal.

Figure 4:
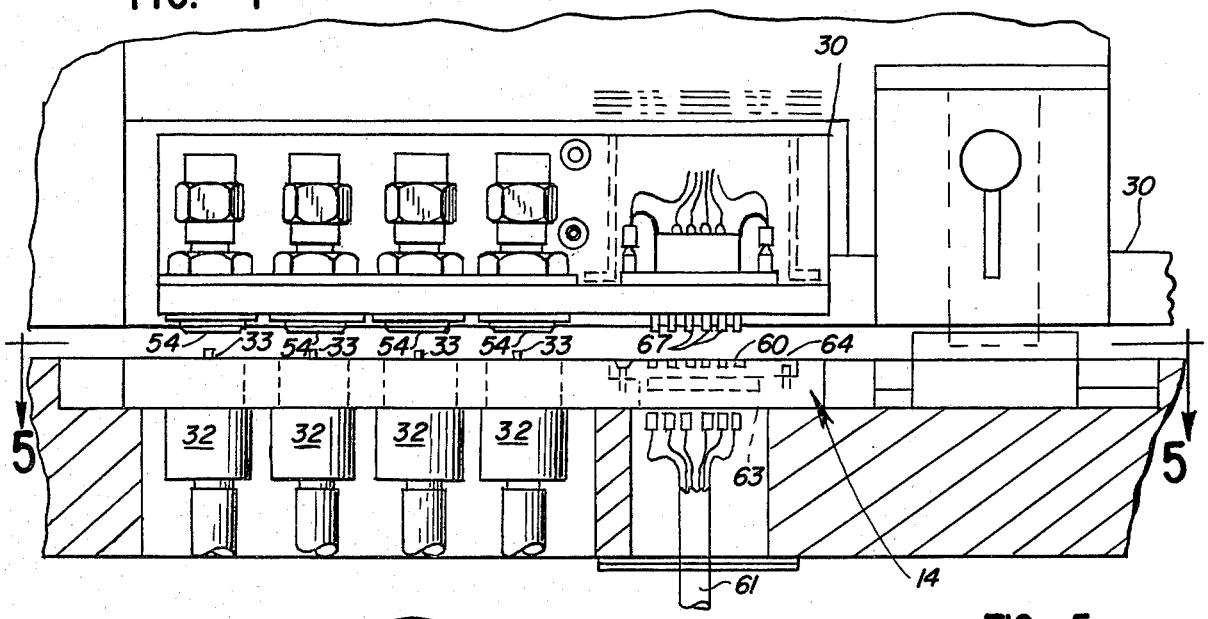
FIG. 4 is an end elevation, partially in section, of the mechanism shown in FIG. 2.
Figure 5:
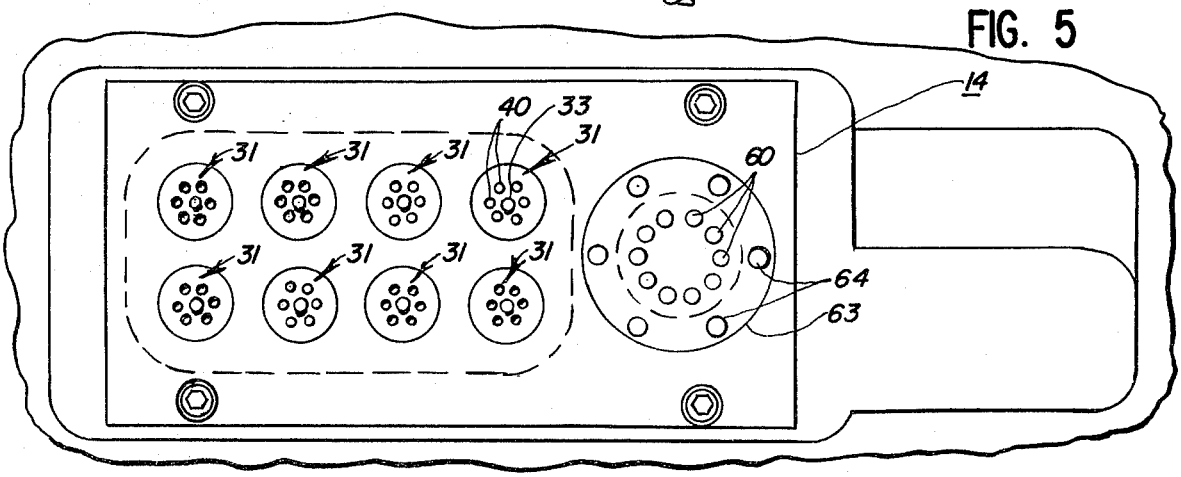
FIG. 5 is a plan view taken generally along line 5—5 in FIG. 4.
Figure 6:
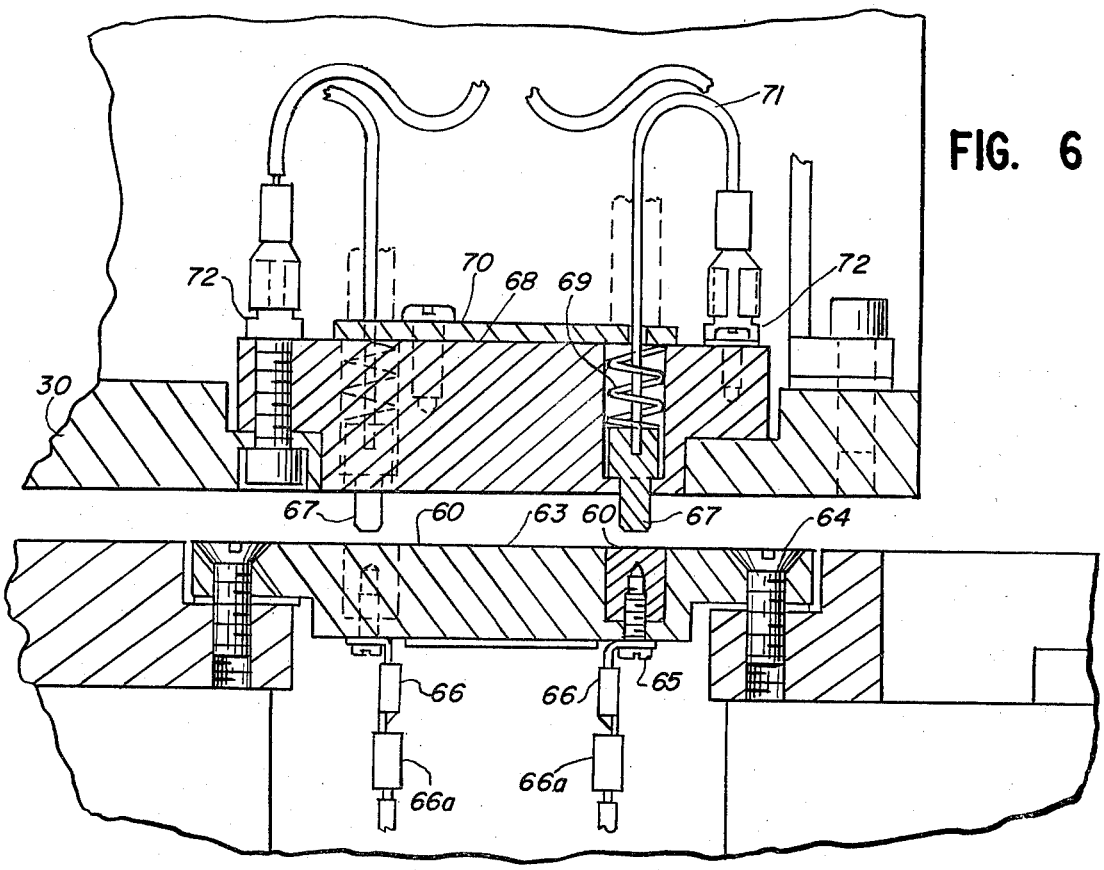
FIG. 6 is an enlarged section taken generally along line 6—6 in FIG. 3.
Figure 7:
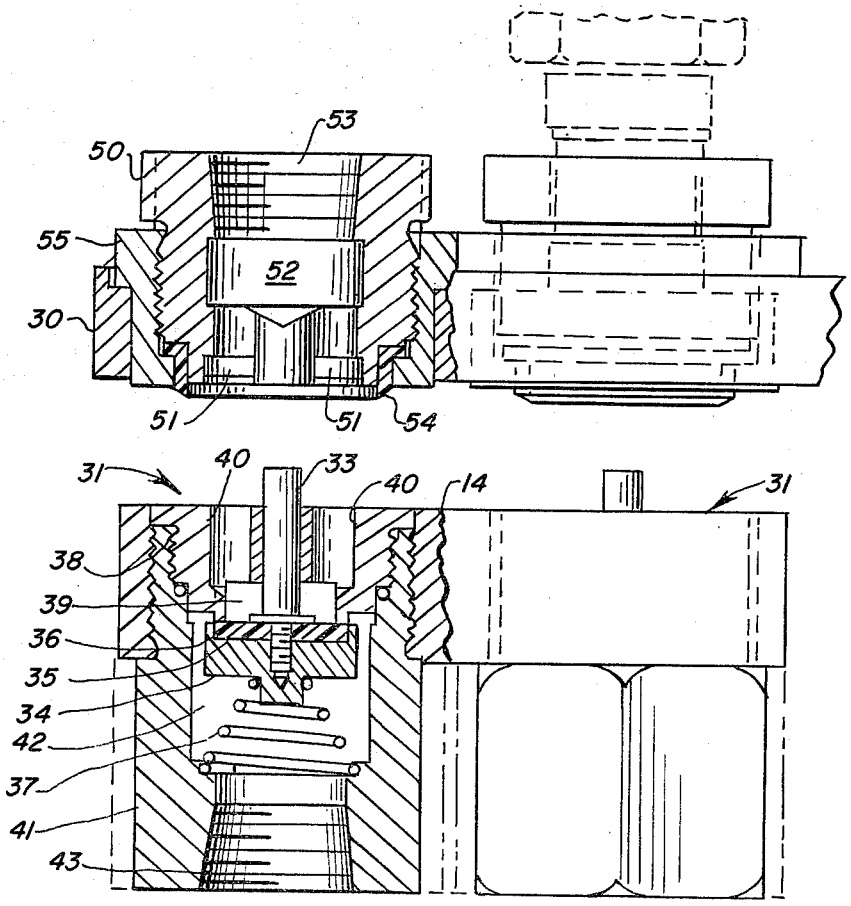
FIG. 7 is an enlarged section taken generally along line 7—7 in FIG. 3.

Turning next to the electrical connectors, which are shown most clearly in FIGS. 4–6, electrical power is supplied to a circular array of ten contacts 60 by means of a harness or cable 61. For safety reasons, power is not supplied to these contacts until one of the carriers 18 or 19 is in position in the press and lowered onto the press bed. The ten contacts 60 are embedded in an insulating disc 63 which is recessed in the top surface of the press bed adaptor plate 14 and fastened thereto by a plurality of screws 64. To connect the individual wires from the harness 61 to the respective contacts 60, a screw 65 is threaded into the bottom of each contact 60 and at the same time anchors a conventional wire connection tab 66 to the underside of the insulating disc 63. These tabs 66 receive complementary connection elements **66*a* affixed to the individual wires from the harness 61**.

When the carrier 18 or 19 is positioned in the press and lowered onto the press bed adaptor plate 14, each of the contacts 60 is engaged by a separate spring-loaded contact 67 which projects downwardly from the bottom surface of an insulating disc 68 recessed in the connector plate 30. These contacts 67 are arranged in a circular array to register with the lower contacts 60, and are biased downwardly by compressed springs 69 to hold each pair of mating contacts 60, 67 in firm engagement with each other. These springs also automatically compensate for any wear on the engaging surfaces of the contacts 60 and 67. The springs 69 are held captive within the insulating disc 68 by means of a disc 70 attached to the top of the disc 68. The upper portion of each of the contacts 67 is enlarged so as to form a radial shoulder which rests against a complementary shoulder formed by the insulating disc 68 near the bottom of each hole formed in the insulating disc for receiving the contacts 67 and the springs 69. The top of each contact 67 is fastened to a lead wire 71 which extends upwardly through the corresponding spring 69 and the disc 70 for attachment to one of a series of tabs spaced around the top surface of the disc 68 for the purpose of connecting the various contacts 67 to the desired electrical control devices.

When the carrier 18 or 19 is lowered onto the press bed adaptor plate 14, the spring-loaded electrical contacts 67 are retracted upwardly within the insulating disc 68 against the bias of the springs 69. This has the effect of increasing the biasing force of the springs 69 to maintain good electrical contact between the upper contact 67 and the lower contacts 60.

When it is desired to remove the carrier 18 or 19 from the press for the purpose of changing dies, the carrier is raised off the press bed. This breaks the electrical connections by separating the contacts 60 and 67, and closes the air valves 32 by releasing the stems 33 so that the springs 37 return the sealing rings to sealing engagement with the valve seats 36. The carrier 18 or 19 is then removed from the press, clearing the press bed connectors for automatic engagement and actuation by the connectors on the next carrier.

The multiple air and electrical lines can be used to supply either power or control signals to the particular pneumatic and electrical devices associated with any given die set. This permits the more sensitive control elements to be located in the main frame of the press, rather than on the dies, if desired.

Although the invention has been illustrated in a press that supplies compressed air and electricity to the carrier connections, it will be understood that automatic connections may be provided for other systems as well, if desired. For example, power presses are often provided with automatic lubricating systems, and the connecting system of this invention can be used to extend such lubricating systems to the dies and/or the die-changing carriers.

As can be seen from the foregoing detailed description, this invention provides an improved automatic die changing system which automatically makes the necessary utility connections and disconnections each time a die set is transferred to or from the press. The need for manual operations to make and break the utility connections when changing dies is completely eliminated by using the normal vertical movement of the die-changing carriers to make and break the various utility connections, and to automatically open and close the air valves, the required connections are made reliably and accurately in an economical manner. There is only a small incremental increase in the cost of the die changing system, and yet significant savings are realized in increased operating time and reduced labor costs and improved safety.

We claim as our invention:

1. An automatic die changing system for a power press having a press bed and carriers for transporting dies to and from a selected location in the press, said system comprising a plurality of air lines and a plurality of electrical lines in the press bed for supplying compressed air and electrical power to the dies on said carriers, said air and electrical lines terminating at the surface of the press bed, a normally closed valve at the end of each of said air lines, said valve being disposed below the surface of the press bed below and communicating with a plurality of apertures in the surface of the press bed, electrical contact means at the end of each of said electrical lines at the surface of the press bed, a plurality of connectors mounted on each of said carriers for movement therewith and positioned to register with said valves and electrical contact means at the surface of the press bed when the carrier is in its operative position in the press bed, said connectors being adapted to automatically connect said air and electrical lines at the surface of the press bed with corresponding air and electrical lines for operating control devices associated with dies on the carrier, in response to the lowering of the carrier onto the press bed, each of the connectors for said air lines having an actuator for automatically opening the valve of the corresponding air line in response to the lowering of the carrier onto the press bed and a fixed sealing ring around the periphery of the connector for engaging the surface of the press bed around said plurality of apertures when the carrier is lowered onto the press bed, each of the connectors for said electrical lines having movable electrical contact means projecting downwardly from the carrier for engaging a corresponding one of said electrical contact means at the surface of the press bed, and biasing means for pressing each pair of engaged electrical contact means firmly against each other at the surface of the press bed when the carrier is lowered onto the press bed.

2. An automatic die changing system as set forth in claim 1 wherein each of said connectors for said air lines includes resilient sealing means for making a sealed connection with one of said valves in response to the lowering of the carrier onto the press bed.

3. An automatic die changing system as set forth in claim 1, wherein each of said connectors for said electrical lines includes electrical contact means for engaging a corresponding contact in the press bed, and biasing means for pressing said contact means into firm engagement with each other.

4. An automatic die changing system as set forth in claim 1 wherein said connectors for said electrical lines are disposed in a common insulating plate mounted on the carrier.

5. An automatic die changing system for a power press having a press bed, said system comprising a plurality of carriers for transporting dies to and from a work station in the press, said dies having a plurality of pneumatically and electrically operated devices, a set of multiple air and electrical lines disposed within the press bed for supplying compressed air and electrical power and control signals for said pneumatically and electrically operated devices, said air and electrical lines terminating adjacent said work station, a set of multiple air and electrical lines on each of said carriers for supplying said compressed air and electrical power and control signals to said pneumatically and electrically operated devices, and connecting means attached to the ends of said air and electrical lines in both of said sets for automatically connecting the two sets of lines in response to the positioning of a carrier at said work station in the press, said connecting means for the air lines including valves and valve actuators for automatically opening the air lines in the press bed when the two sets of air lines are connected and for automatically closing the air lines in the press bed when the two sets of air lines are disconnected, each of said valves being disposed below the surface of the press bed and communicating with a plurality of apertures in the surface of the press bed, each of the air line connecting means on said carriers having a fixed sealing ring for engaging the surface of the press bed around said plurality of apertures when the carrier is lowered onto the press bed, and each of the electrical line connecting means on said press bed having an electrical contact at the surface of the press bed, and each of the electrical line connecting means on said carriers having a movable electrical contact projecting downwardly from the carrier for engaging a corresponding contact at the surface of the press bed, and biasing means for pressing each pair of engaged electrical contacts firmly against each other at the surface of the press bed when the carrier is lowered onto the press bed.

6. An automatic die changing system as set forth in claim 5 wherein the connecting means for said air lines include resilient sealing means for making sealed connections between the respective air lines in the two sets in response to lowering of the carrier onto the press bed.

7. An automatic die changing system as set forth in claim 5 wherein the connecting means for said electrical lines include cooperating sets of electrical contacts and biasing means for pressing said contacts into firm engagement with each other.

8. An automatic die changing system as set forth in claim 5 wherein the connecting means for said electrical lines are disposed in a pair of insulating plates, one of which is mounted in the press bed and the other of which is mounted on the carrier.

* * * * *